United States Patent [19]

Goudy, Jr.

[11] 4,401,039

[45] Aug. 30, 1983

[54] FUEL PREPARATION AND BURNING SYSTEM

[76] Inventor: Paul R. Goudy, Jr., 2016 Eastwood, Shorewood, Wis. 53211

[21] Appl. No.: 189,824

[22] Filed: Sep. 23, 1980

[51] Int. Cl.[3] ..... F23D 1/00

[52] U.S. Cl. ..... 110/347; 110/218; 110/263; 110/326; 110/345; 431/353

[58] Field of Search ..... 110/347, 263, 322, 323, 110/326, 232, 218, 345; 431/158, 353, 7, 170, 2; 122/44 A, 155 A; 55/73

[56] References Cited

U.S. PATENT DOCUMENTS

| | | | |
|---|---|---|---|
| 3,133,527 | 5/1964 | Mizer | 431/353 X |
| 3,266,725 | 8/1966 | Garrison et al. | 236/15 BB |
| 3,799,734 | 3/1974 | Bailey | 431/353 |
| 3,941,552 | 3/1976 | Cottell | 110/347 X |
| 4,021,191 | 5/1977 | LaHaye | 431/353 |
| 4,057,021 | 11/1977 | Schoppe | 110/347 X |
| 4,178,349 | 12/1979 | Wienert | 110/345 X |
| 4,195,779 | 4/1980 | Auclair et al. | 431/8 X |
| 4,258,017 | 3/1981 | Gelfand | 110/203 X |

FOREIGN PATENT DOCUMENTS

| | | | |
|---|---|---|---|
| 143883 | 6/1931 | Switzerland | 122/155 A |

*Primary Examiner*—Edward G. Favors

[57] ABSTRACT

A fuel, such as coal, is prepared by mixing with a petroleum product and possibly other materials to form a grease-like substance. In a motionless mixer the grease-like substance is combined with air to form a foam-like dispersion of fuel and air. Such foam-like dispersion is delivered substantially continuously to a combustion chamber for combustion thereat. The combustion chamber is relatively closed and has means cooperative with the foam-like dispersion and the pressure of expanding gases of the combustion process to impede flow of the foam-like dispersion therein; consequently the foam-like dispersion is maintained at a pressure head to maintain the air dispersion therein. The speed and heat of combustion may be controlled by controlling flow rate or pressure of the foam-like dispersion. Means are provided for reducing pollutants and for efficiently transferring heat out from the combustion chamber.

30 Claims, 11 Drawing Figures

FUEL PREPARATION AND BURNING SYSTEM

TECHNICAL FIELD

The invention relates to fuel preparation, to a burning system for such prepared fuel, and to a method of effecting the same. More particularly, the invention is directed to preparation of a fuel containing particulate material, especially coal, to a system for burning such a fuel in an efficient and preferably minimum polluting manner, and to a method for the same. Although the invention is described below with references specifically to employing coal as the principal combustible in the fuel, it will be appreciated that other combustibles may be used in accordance with the spirit and scope of the invention.

BACKGROUND OF PRIOR ART

There are a number of prior techniques for burning coal ranging from shoveling coal into the fire box of a boiler and pulverizing coal and spraying the pulverant through a nozzle into a furnace, to grating and fluid bed combustion techniques, these latter techniques enabling combustion of the greatest amount of product on a large scale. However, there are problems with the grate and fluid bed combustion techniques, namely the large amount of pollutants going up the stack, the difficulty in controlling the combustion, certain inefficiencies in removing heat from the relatively open combustion chamber and control of temperature. Another difficulty encountered with coal combustion is the transportation and handling of the coal including particularly delivery of the coal to the combustion chamber, often a messy and breakdown-prone experience.

BRIEF SUMMARY OF INVENTION

A number of the disadvantages encountered in prior coal handling, preparation and combustion systems are overcome in the present invention. Particulate coal, such as coal fines or the like, is washed, at least partially dried, and combined with a lubricant or binder and possibly other additives to form a grease-like substance. In a motionless mixer, the grease-like substance and air (or other source of oxygen or other material that will support combustion or a combustion-like process, hereinafter simply referred to as air) are combined to form a foam-like dispersion of fuel and air. The foam-like dispersion is pumped under a pressure head into a combustion chamber preferably on a continuous basis although an intermitent combustion process is possible, and the combustion chamber is relatively closed to confine the combustion process therein while maintaining pressurization of the foam-like dispersion input thereto and thus the dispersion of air relative to the coal. Although such mixture of coal material and air would desirably be foam-like in consistency, hence the reference to foam-like dispersion, the latter may also be understood to refer herein to a relatively long-lasting dispersed mixture of the fuel and material to support combustion thereof, e.g. a mixture of coal and air. Heat efficiently is removed from the heat exchanger by conduction via heat conductive members which preferably extend directly between the interior and the external environment of the combustion chamber.

One aspect of the invention relates to a combustion apparatus including a combustion chamber of substantially constant or otherwise controlled cross-sectional open area, an inlet for permitting fuel and air to enter the combustion chamber, and an outlet for permitting exhaust products of combustion to exit the combustion chamber. Features of such combustion apparatus include means for maintaining pressure on a mixture of such fuel and air during combustion thereof, dispersing means in the combustion chamber for controllably dispersing a mixture of the fuel and air therein, thermally conductive heat transfer means exposed inside and outside the combustion chamber for transmitting heat by conduction from inside the combustion chamber to the outside, and flow means for directing the flow of fuel and air in the combustion chamber, the flow directing means including means for chemically lowering the quantity of at least one material in the exhaust products of combustion.

Another aspect of the invention relates to an apparatus for combustion of fuel including means for forming a foam-like mixture of fuel and air, and means for maintaining pressurization of the foam-like mixture to retain the air therein while permitting combustion of the mixture. Back pressure and, thus, flash back control also preferably are provided.

Another aspect relates to an apparatus for controlling combustion of the fuel including means for forming a fluid-like mixture of the fuel and air, a combustion chamber in which the combustion of such mixture may occur, means for supplying the mixture to the combustion chamber for combustion therein while maintaining a relative pressurization of the mixture to retain relative dispersion of fuel and air therein, and means for controlling at least one of the flow rate and pressure of the mixture supplied to the combustion chamber thereby to control combustion in the combustion chamber.

Another aspect relates to an apparatus for preparing and burning coal including combining means for combining particulate coal with a petroleum or petroleum-like material to form a mixture having grease-like characteristics, mixing means for mixing the grease-like mixture with air to form a foam-like dispersion mixture thereof, means for maintaining a relative pressure on the foam-like dispersion mixture to retain the relative dispersion of coal and air thereof, and a combustion chamber providing an environment for controlled combustion of the coal and air of the foam-like dispersion mixture.

Other aspects of the invention relate to arrangements for efficiently removing pollutants from the combustion exhaust gas, a method of combustion (particularly controlled combustion) of a fuel, a method of preparing particulate fuel for combustion, and a method of preparing and burning coal.

In a method of combustion of a fuel, particulate fuel is combined with a further material to form a fluid-like emulsion thereof, air is mixed with the emulsion to form a foam-like material, and combustion of the foam-like material is effected while maintaining at least partial relative pressurization thereof.

In the method of controlling combustion of a fuel, a fluid-like mixture of fuel and air is formed, the fluid-like mixture is supplied to a combustion chamber while maintaining a relative pressurization of the fluid-like mixture to retain the relative dispersion of air and fuel therein, combustion is effected in the combustion chamber, and at least one of the flow rate and pressure of the fluid-like mixture supplied to the combustion chamber is controlled there by to control combustion.

The particulate fuel may be prepared for combustion by combining a fluid material with the fuel to form a fluid-like mixture thereof and mixing air with the fluid-like mixture to form a foam-like mixture or dispersion.

The method of praparing and burning coal includes combining particulate coal with a petroleum or petroleum-like material capable of forming a mixture having grease-like characteristics, mixing the grease-like mixture with air to form a foam-like dispersion mixture thereof, maintaining a relative pressure on the foam-like dispersion mixture substantially to maintain the relative dispersion of air and grease-like material, and effecting combustion of the foam-like mixture.

With the foregoing in mind, principal objects of the invention are to provide an improved process and to provide an improved apparatus for combustion.

Another object is to improve efficiency of a combustion process.

An additional object is to reduce pollutants, including gas and solid by-products of combustion.

A further object is to improve efficiency with which heat can be removed from a combustion process.

Still another object is to control effectively a continuous combustion process.

Still an additional object is to prepare a fuel for combustion in an efficient manner minimizing handling and transport complexities.

Still a further object is to facilitate combustion of fuel and use of the energy of combustion.

Even another object is to obtain the foregoing objects especially using coal as the fuel or a component thereof.

Even an additional object is to prepare a coal base fuel that can be pumped with minimum abrasion.

These and other objects and advantages will become more apparent as the following description proceeds.

To the accomplishment of the foregoing and related ends, the invention, then comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF INVENTION

Figure 1:
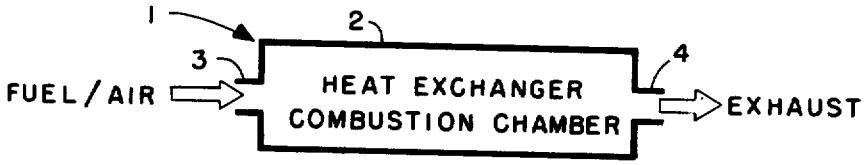
FIG. 1 is a schematic representation of a heat exchanger combustion chamber in accordance with the present invention.
Figure 2:
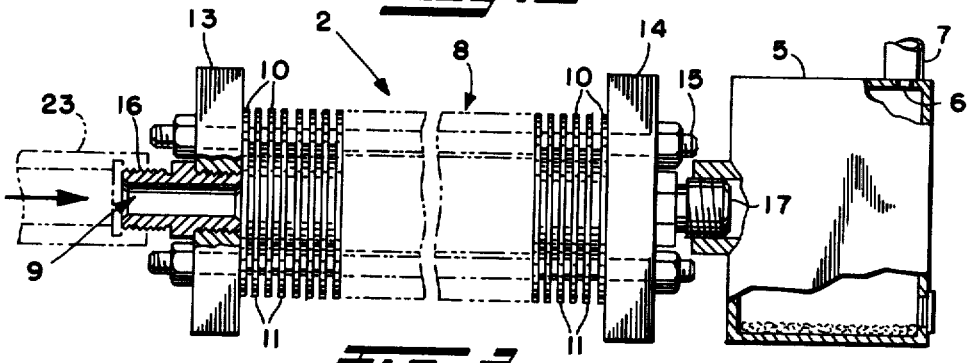
FIG. 2 is a side elevation view, partly broken away in section, of the heat exchanger combustion chamber of FIG. 1.
Figure 3:
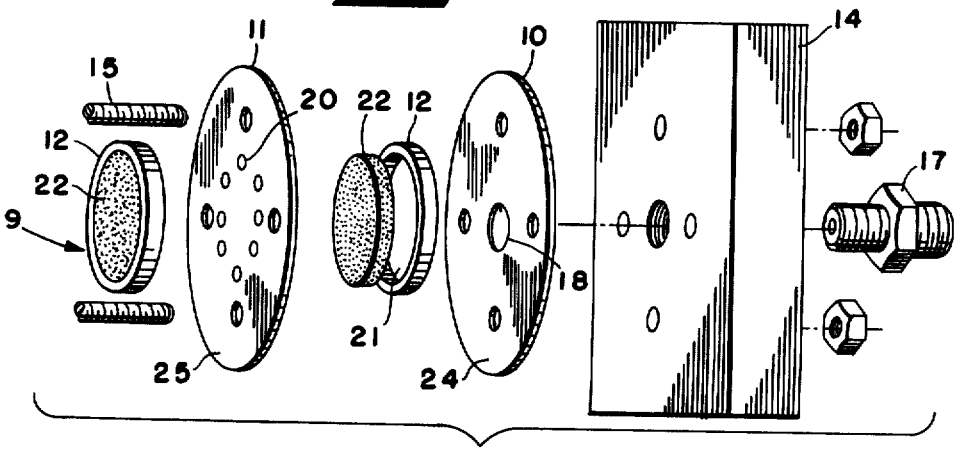
FIG. 3 is a fragmentary exploded view of the heat exchanger combustion chamber of FIG. 1.

Referring in detail to the drawings, and initially to FIGS. 1, 2 and 3, a combustion apparatus 1 in accordance with the present invention is illustrated. The combustion apparatus 1 includes a heat exchanger combustion chamber 2 (for brevity referred to below sometimes as combustion chamber) preferably having a substantially constant or otherwise controlled cross-sectional open area. An inlet 3 permits fuel and air to enter the combustion chamber 2, and an outlet 4 allows the exhaust products of combustion to exit the combustion chamber. A heat exchanger function is an integral part of the combustion chamber 2 directly to remove the heat of combustion from the interior to the external environment of the combustion chamber.

A mixture of fuel and air is delivered continuously to the combustion chamber 2. Such mixture preferably has the air well dispersed in the fuel which may be achieved by first forming a foam-like dispersion of fuel and air, pumping the same through the inlet 3 into the combustion chamber 2 at a pressure head and maintaining pressurization within the combustion chamber 2 during the combustion process. Such pressurization may be achieved by maintaining substantially constant or otherwise controlled cross-sectional open area of the combustion chamber, providing impediments to flow with the combustion chamber, and, if desired, providing an outlet expansion chamber 5 (FIG. 2) with a flow controlling orifice 6 between the expansion chamber and the stack 7 through which the exhaust gases ordinarily would flow and exit to the external environment.

In FIGS. 2 and 3 details of the heat exchanger combustion chamber 2 are illustrated.

Reference is made to co-pending, commonly owned U.S. patent application Ser. No. 148,022, filed May 8, 1980, entitled "Thermal Energy Transfer Apparatus and Method" which discloses the principles of construction and operation of a heat exchanger similar to the heat exchanger combustion chamber 2 of the present invention. The disclosure of such co-pending patent application hereby is incorporated by reference.

Fundamentally, the combustion chamber 2 may be considered to have an external housing 8 and an internal flow path 9 therethrough. The housing 8 is formed by a plurality of thermally conductive plates or discs 10, 11, separator rings 12, and end plates 13, 14, which are clamped together by fasteners 15. The flow path 9 is formed by openings through the end plates 13, 14 in which inlet and outlet fittings 16, 17 are threaded securely, centrally located openings 18 in the discs 10 in axial alignment with the inlet and outlet fittings 16, 17 along the axis 19 of the combustion chamber 2, openings 20 in the discs 11 spaced radially relative to the axis 19 but within the circumference of the respective rings 12, and the hollow interiors 21 of such rings. Means, not shown, may be provided between rings 12 and discs 10 or 11 and between discs 10 and respective ends plates 13, 14 to prevent fluid leakage between the flow path 9 and the external environment of the housing 8. The rings 12 accordingly provide chambers between discs 10, 11 in which the foam-like or other material may mix and may confront and transfer heat to the surface areas of discs 10, 11 bounding the ring interior 21. In the preferred embodiment and best mode a thermally conductive porous disc or medium 22 is positioned in the hollow interior of each ring 12. The ring is a holder for such disc 22.

In operation of the heat exchanger combustion chamber 2 a foam-like mixture of coal, air and possibly additional additives or materials is delivered to the inlet fitting 16 via a tube or pipe 23 under a pressure head developed by an upstream pump, not shown in FIGS. 1 through 3. The disc most proximate the inlet end plate 13 is the disc 10 having a central opening 18, which is also the case with respect to the disc 10 adjacent the outlet end plate 14; the discs 10, 11 otherwise are alternated along the axis 10. Accordingly, the main flow stream passing through the central opening 18 of the first most upstream disc 10 must divide into multiple flow streams radially spaced outwardly relative to the axis 19 to pass through the openings 20 of the next downstream disc 11; the multiple flow streams formed by the disc 11 then are merged or combined as the flow through the opening 18 of the next downstream disc 10; and so on. As a result of such dividing and recombining of the material flowing through housing 8 there is an appreciable amount of mixing of such material maintaining the homogeneity thereof and there also is a substantial amount of contact by such material with surfaces of the discs 10, 11 exposed in the flow path 9. Multiple direction changes of the material flowing in flow path 9 tends to impede flow therethrough to maintain continuous back pressure opposing the pressure head under which the material is pumped and produces a head pressure for the flame preventing flashback. In the main, though, the sum of cross-sectional areas of radial openings 20 in a disc 11 equals that of central opening 18 in a disc 10 so that flow impedance is created by direction changes and stream dividing rather than by flow restrictions. Generally the fill material, e.g. porous disc 22, also has an equivalent cross-sectional open area relative to the principal direction of flow of material therethrough.

Combustion of the material flowing through the combustion chamber 2 along the flow path 9 may be started by conventional means, such as, for example, spark ignition, glow wire ignition, or flame ignition, each of which may gain access to the flow path 9 through an opening, not shown, in the housing 8. Alternatively, heat may be applied to surface areas 24, 25 of the discs 10, 11 exposed to the external environment of the housing 8 outside the flow path 9, with such heat being conducted via one or more such discs to ignite combustion of the material in the flow path 9; or other combustion igniting means may be used.

With combustion commenced, combustion will continue ordinarily as long as the mixture of fuel and air is supplied to the combustion chamber. During such continuing combustion the expanding gases produced by such combustion further will create a back pressure opposing the pressure head of the material pumped into the inlet fitting 16. The back pressure so created as well as the mixing in the flow path 9 help to assure continued retentive dispersion of air in the coal mixture of material flowing through the flow path for optimum efficiency and completion of combustion within the flow path 9. The exhaust products of combustion leave the flow path 9 via the outlet fitting 17 and enter the expansion chamber 5. The orifice 6 leading to the stack 7 causes a pressure ordinarily to be maintained in the expansion chamber 5 further opposing the noted pressure head. Moreover, the cooperation of expansion chamber 5 and orifice 6 helps to even out pressures in a parallel stream system with a common stack as shown simplifying the control procedure described below. Such cooperation also permits solid ash or other materials carried in the exhaust products of combustion to drop to the bottom of the expansion chamber 5 from which they can be removed effectively without uncontrolled discharge through the stack 7.

The constant or controlled cross-sectional area consideration allows extruding of the burning mass through the combustion chamber 2. This provides a scrubbing action which aids in moving the ash through, into the expansion chamber for facile removal therefrom.

Efficient removal of heat from the heat exchanger combustion chamber 2 by means of direct conduction through the discs 10, 11 is achieved by the substantial area of such discs exposed within the flow path 9 as delimited by the area circumscribed by respective rings 12. The disc surface areas 24, 25 then transmit heat to the environment externally of the housing 8.

The disc or waffers 22 may provide a plurality of functions. The discs 22 are porous to the material flowing through the flow path 9 to the extent that such discs preferably help to disperse material flowing therethrough thereby to achieve continued dispersion of air in the mixture. The discs 22 also may have good thermal energy conductive properties such that as combustion occurs therein heat is transferred therethrough directly by conduction at the surfaces thereof engaged with respective discs 10, 11 for conduction then via the discs 10, 11 to the external surface areas 24, 25 and the external ambient environment. Furthermore, the discs 22 may be formed of a material that is degradable or chemically reactive with respect to the materials undergoing combustion or to affect such combustion and/or the ultimate products of combustion; for example, the discs 22 may be formed at least in part of a limestone material that reacts with sulphur in the coal to remove such sulphur from the exhaust gases. The discs 10, 11 also may be formed of such or other type of degradable material. As a result relatively high sulphur coal can be burned with minimum sulphur pollution emitted to the air without the need for expensive scrubbers and the like. Alternatively, the discs 22 may be formed of metal mesh or of filter-like material, such as stainless steel, which provides the desired dispersing and thermal conducting properties, for example, as is disclosed in the above-mentioned co-pending application.

Figure 4A:
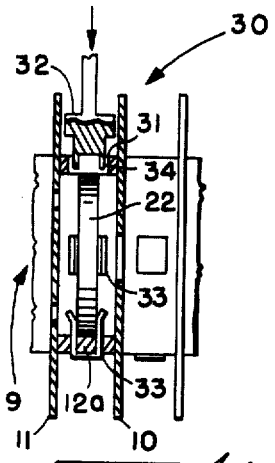
FIG. 4A is a fragmentary side elevation view, partly broken away in section, of a modified heat exchanger; combustion chamber.

It may be necessary to change the discs 22 relatively frequently with clean ones or with unreacted ones, i.e. unreacted with sulphur. In FIG. 4A is illustrated an access assembly 30 to facilitate gaining access to respective discs 22 within rings **12*a* without disassembling the fasteners 15 and other components of the heat exchanger combustion chamber 2 housing 8. In the access assembly 30*a* hatch 31 in the ring 12*a* allows direct access to the disc 22 when a hatch cover 32 is removed. Fingers 33 near the bottom and sides of the ring 12*a*, as shown, and fingers 34 on the hatch cover center the disc 22 generally in parallel between the discs 10, 11. The fingers 34 also may be used to grasp the disc 22 for removal as the hatch cover 32 is removed and for directing a new disc 22 into place. If desired, the access assembly 30 may be modified such that approximately one-half of the ring 12*a* is entirely removable rather than using the hatch 31 and hatch cover 32 approach; in such modified arrangement the axial dimension of the disc 22 may be such that it will engage surfaces of both discs 10, 11**.

Figure 4C:
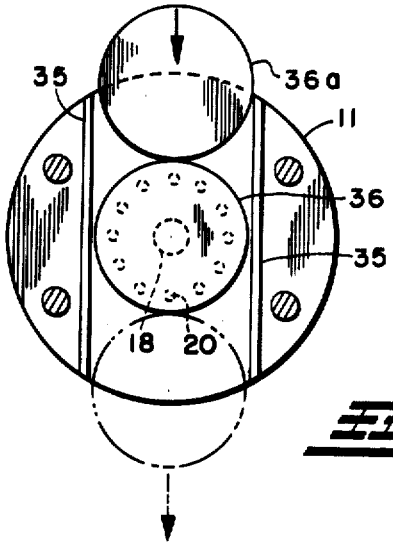
FIGS. 4B and 4C are, respectively, a fragmentary side elevation view and an internal view looking in the direction of the arrows 4C—4C of FIG. 4B sharing a further modified heat exchanger combustion chamber.
Figure 4B:
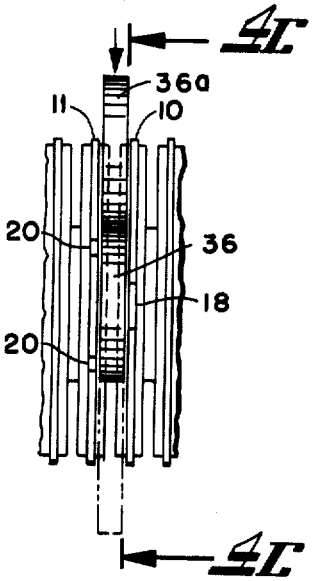

In FIGS. 4B and 4C is illustrated another embodiment to facilitate the replacement of discs 22 between discs 10, 11 without disassembling the housing 8 of the combustion chamber 2. In such embodiment each disc 10, 11 has tracks 35 thereon. An assembly 36 comprised of a ring 12 and a disc 22 is positioned between the pair of tracks 35 on the disc 11 as well as between the pair of tracks on the confronting disc 10 in position in the flow path 9. A new assembly 36a may be positioned in readiness relative to the tracks 35 and discs 10, 11 to be pushed down into the flow path 9 while ejecting the original assembly 36 without interrupting the flow of material and exhaust products of combustion through the flow path 9 and without stopping the process of combustion therein. The ejected assembly 36 may be removed for recycling or for disposal, and a new assembly 36a may be placed in position in readiness for the next change.

It is contemplated that other means may be provided to replace discs 22 in the combustion chamber 2 preferably without diassembling the same. Thus, as the discs become dirty with ash, otherwise chemically reacted or used, etc., efficiency of the heat exchanger still may be maintained.

In using the combustion chamber 2, then, it will be appreciated that a mixture of air and fuel, such as coal, possibly plus additional additives, binders, lubricants, and so on, is delivered under a pressure head via the tube 23 into the inlet fitting 16 and along the flow path 9 of the housing 8. Combustion occurs continuously in the flow path 9 and heat is removed from the flow path to the environment externally of the housing 8 by conduction through the discs 10, 11 which penetrate into the flow path and extend outside the housing 8. It is contemplated that the combustion will occur at a controlled manner and by controlling the flow rate and pressure head of the material delivered into the combustion chamber 2 the thermal energy, such as the Btu's delivered via the discs 10, 11 and the temperature thereof can be controlled. If desired, to increase the total thermal energy obtained, plural combustion chambers 2 may be connected in fluid parallel relation, e.g. manifold from a common pump and supply of fuel/air mixture therefor, thus increasing the total thermal energy capacity of such system without changing the size of any individual combustion chamber 2. The outlet fittings 17 of such parallel heat exchangers combustion chambers may be connected to a common expansion chamber 5 and stack 7 or to individual ones, as desired, although the former case would be preferred to maintain uniform pressure in all the combustion chambers.

Figure 5:
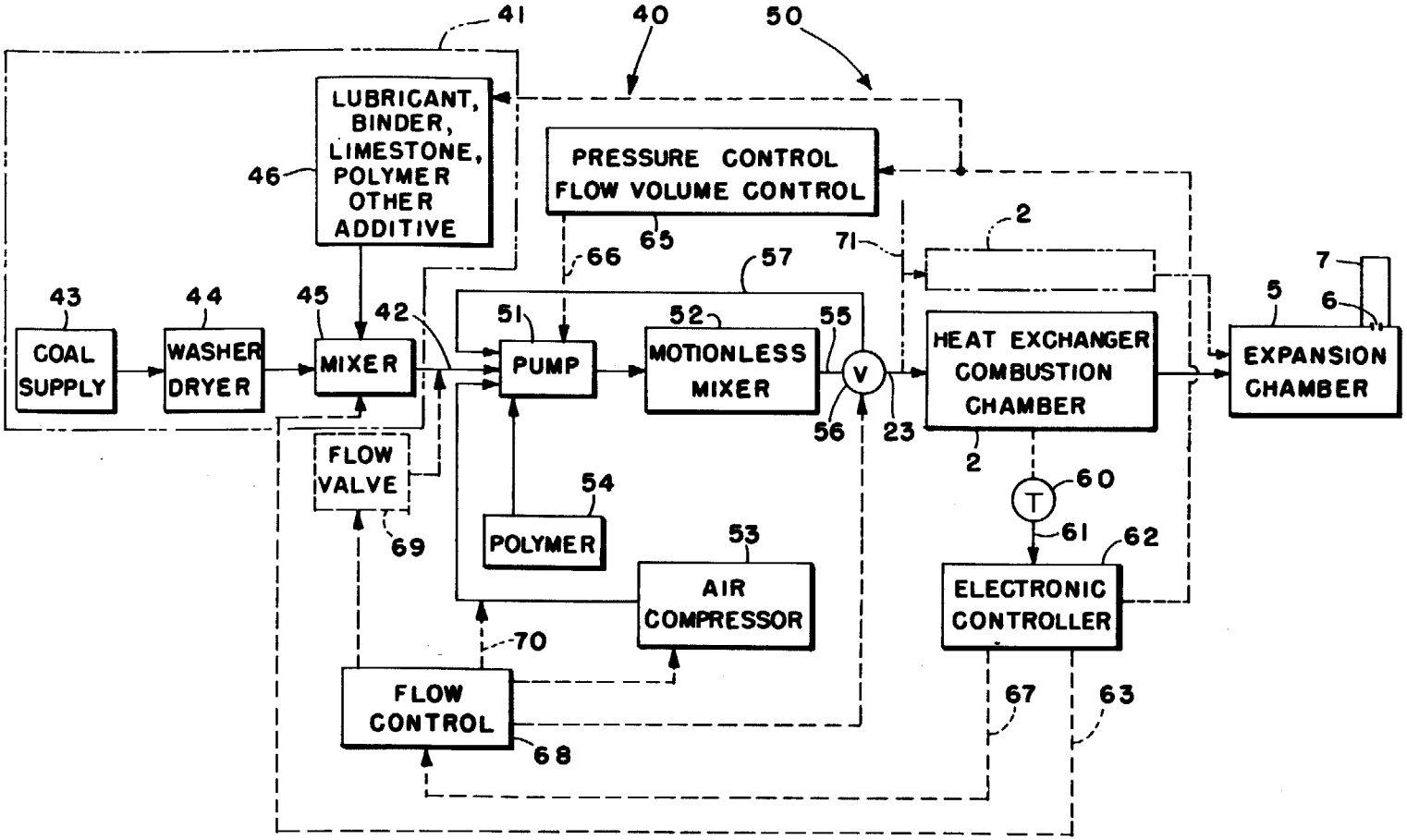
FIG. 5 is a schematic system diagram of a fuel preparation and burning system in accordance with the present invention.

Turning now to FIG. 5, a system 40 for preparing and burning coal to other fuel is illustrated schematically. The system 40 includes a preliminary preparation stage 41, which may be of conventional equipment used to make and to deliver at line 42 a prepared coal material having a grease-like consistency capable of being pumped with minimum abrasion and also being capable of facile transportation and handling in relatively clean fashion. Coal from a supply 43, such as coal fines, pulverized coal, other particulate coal or the like, is washed and at least partially dried in a washer/dryer of conventional form 44. Clay and other materials accordingly are washed from the coal and preferably the coal only is partially dried. Moist coal is then mixed in a conventional mixer 45, such as a screw type mixer or the like with an additive from a supply 46. The additive preferably includes a petroleum product binder, such as oil, which when mixed with the moist coal will form a grease-like substance provided to line 42. Moreover, the additive may include limestone for removing sulphur from the exhaust products of combustion in the combustion chamber 2. Additionally, the additive may include polymer that is a water scavenger and reacts therewith to help from the gell-like or grease-like consistency of the material delivered to line 42. A disclosure of such polymer additive is in Goudy, Jr. U.S. patent application Ser. No. 06/108537, filed Dec. 31, 1979, which application is not commonly assigned with the present application. The amounts of respective additives may be varied as desired, depending on the required end result of material consistency, combustibility, sulphur or like removal and so on.

The system 40 also includes a final preparation, combustion and control stage 50. The preliminary preparation stage 41 may be on the premises and on-line directly with the stage 50; alternatively, the preliminary preparation stage 41 may be located elsewhere and the grease-like material transported by conventional means for delivery into line 42 which is the inlet to the stage 50.

In the final preparation, combustion and control stage 50 the grease-like material in line 42 is pumped by a pump 51 into a motionless mixer 52, such as a motionless mixer generally of the type disclosed in co-pending, commonly assigned U.S. patent application Ser. No. 897,670, filed Apr. 19, 1978, U.S. Pat No. 4,259,021 which will be described summarily below. Air or a direct supply of oxygen, if desired, also is delivered to the pump 51 from an air compressor 53. Further, if desired, polymer, such as that mentioned above, may be delivered to the pump from a polymer supply 54, the polymer providing further water scavenging, oxygen dispersion and entrapment in the mixture, and possibly other properties as well. As the material is pumped by the pump 51 through the motionless mixer 52 the air will become well dispersed in the grease-like material in a manner such that the effluent at the output 55 of the motionless mixer 52 is of a foam-like or relatively homogeneous consistency. A flow control valve 56 may be operated to cause all, part of or none of the foam-like effluent to pass through to the line or tube 23 to a combustion chamber 2 or to be fed back via a by pass line 57 to the pump 51. Thus, controlling the valve 56 or the pump 51 allows variation in the flow rate and pressure of the foam-like effluent delivered to the combustion chamber 2.

The temperature or other parameter of the combustion chamber 2 may be monitored by one or more temperature sensors 60, which may be mounted, for example, on the surfaces 24 or 25 of one or more of the discs 10, 11, and the electrical output 61 from such temperature sensor(s) may be coupled to a conventional electronic controller 62, for example, that effects an analog type control function. Digital control techniques also may be used. The electronic controller 62 is connected by line 63 to control the mixer 45, such as the speed thereof thereby controlling consistency of the grease-like material provided on line 42. Line 64 connects the controller 62 to the additive supply 46 for metering the additives delivered into the mixer 45. Line 64 also is connected to a pressure control or flow volume control 65 which is connected in turn by line 66 to control operation of the pump 51, and, therefore, the flow rate or pressure of the material pumped through the motionless mixer 52 and, accordingly, the pressure head of the foam-like material delivered into the combustion chamber 2. The control 65 also may be operated manually, if desired, in convention manner. Further, the electronic controller 62 may operate the control 65 to shut down the pump 51 in the event that a critical situation is sensed. Line 67 couples the electronic controller 62 to a flow control 68, which may operate a flow valve 69 associated with line 42 to control the rate at which the grease-like material is delivered to the pump 51. The flow control 68 also may control the valve 56 and operation of the air compressor 53 thereby controlling the flow output and pressure effected by the latter. Furthermore, line 70 represents a valve type operational control of the air flowing between the air compressor 53 and the pump 51.

In using the system 40 coal is prepared in the preliminary preparation stage 41 to form a grease-like material that may be conveniently and relatively cleanly handled with time and cost efficiency. Such material also may be efficiently combined with air for subsequent combustion in the combustion chamber 2, which is closed to other external air supply, for achieving a continuous combustion process. Heat removed from heat exchanger combustion chamber 2 may be used to do work, to effect space heating, and the like, as is well known. Both safety and temperature control may be effected via the temperature sensors 60, electronic controller 62 and the control lines and systems mentioned above. If desired, plural heat exchanger combustion chambers 2 may be connected in parallel, as is schematically represented in FIG. 5, and valve control means may be placed in the manifold line 71 for allowing or cutting off flow of material for combustion in respective combustion chambers under control of the electronic control 62 or by other means, now shown.

Thus, the electronic controller 62 may be a speed versus temperature analog control system. Information may be fed into the electronic controller 62 relating to data on the grease-like material provided on line 42, such as whether the lubricant added to the coal is a number 1 oil, a number 2 oil, etc., the approximate sulphur content in the coal from the coal supply 43, and so on, which information may be provided directly from the supplier of the grease-like coal product. When used in a complete on-line system with both preliminary and final stages 41, 50, electronic controller 62 also may control the amount of additive delivered to mixer 45 from the additive supply 46 as a function of the material of which the lubricant is formed, the size of the particulate coal from the coal supply 43, the wetness of the material delivered from the washer/dryer 44, the sulphur content of the coal, and possibly other information.

Figure 6:
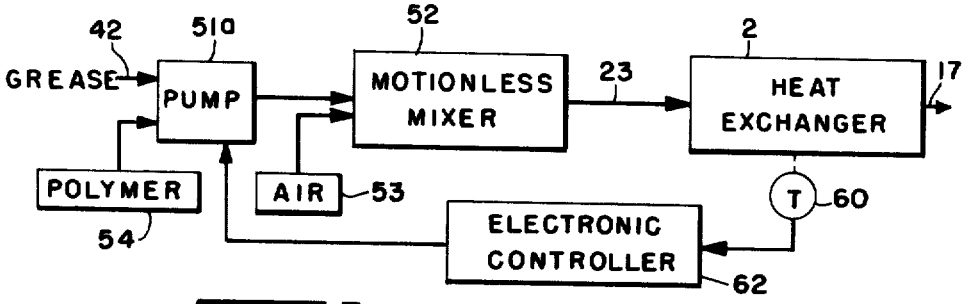
FIG. 6 is a fragmentary schematic system diagram of a modified fuel preparation and burning system in accordance with the present invention.

Turning briefly to FIG. 6, a modified final preparation, combustion and control stage 50*a* which may be substituted in the system 40 for the stage 50 thereof is illustrated. The modified stage 50*a* is simplified from that shown in FIG. 5 because the pump 51*a* is capable of direct control readily to control flow rate and head pressure; accordingly the pump 51*a* is a variable displacement and variable rate pump. Using the pump 51*a* the valve 56 may be eliminated as may be other portions of the control system illustrated in FIG. 5. Air from an air compressor 53 and polymer from a polymer supply 54 may be added, as shown in FIG. 6, for ultimate mixing in the motionless mixer 52 with the grease-like coal material to form a foam-like effluent or output delivered via line 23 to the combustion chamber 2 for combustion as above. The temperature sensor 60 and electronic controller 62 control the displacement and speed of the pump 51*a* thereby to control flow rate and pressure head to the material delivered to the combustion chamber 2.

For optimum operation in either stage 50 or 50*a* as used in a system 40 in accordance with the present invention, it is desired that the pressure head and flow rate of the material delivered to the combustion chamber 2 be adequate to maintain the desired temperature or Btu output from the latter as well as to continue combustion in the heat exchanger on a continuous basis.

Figure 7:
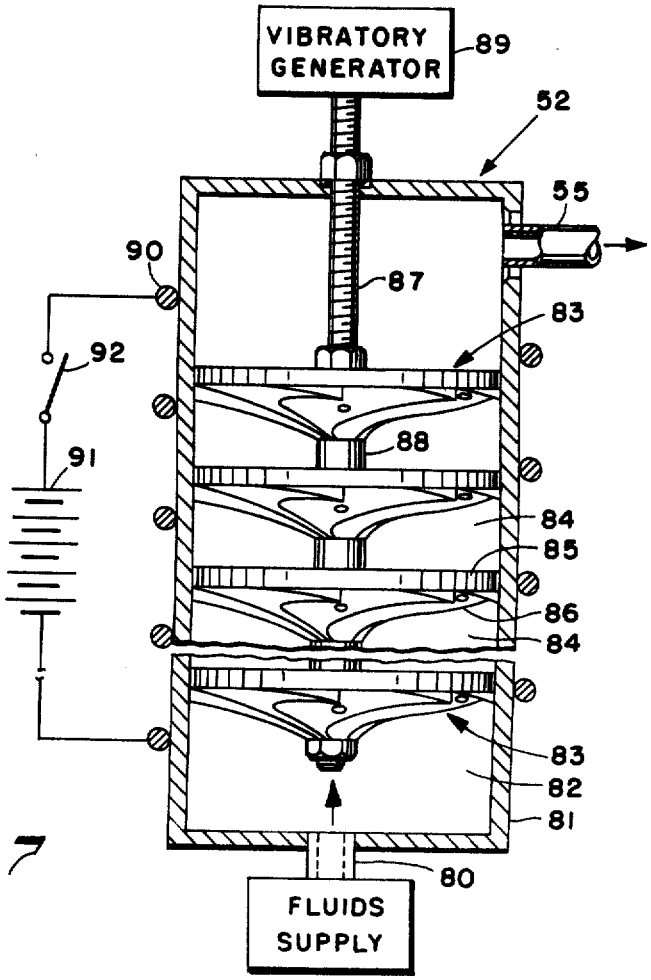
FIG. 7 is a side elevation partial section view of a motionless mixer for use in the invention.
Figure 8:
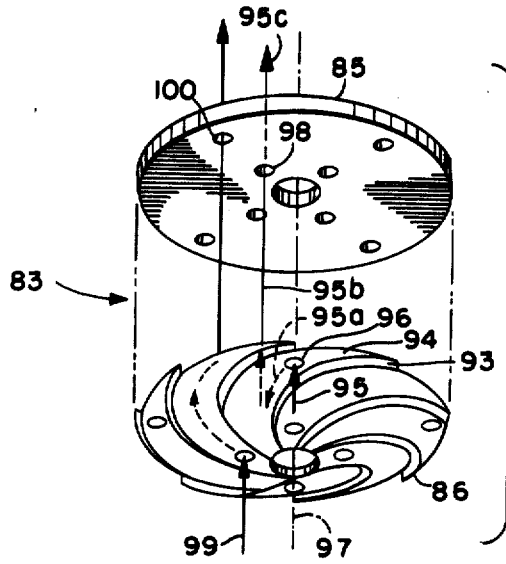
FIG. 8 is an exploded view of a mixing element of such motionless mixer.

Referring now to FIGS. 7 and 8, a motionless mixer 52 preferred in the present invention for dispersing air in the grease-like material to produce a foam-like effluent at the mixer output 55 is illustrated. Fluids, such as the grease-like coal material and air are supplied under pressure from the pump 51, compressed air generator 53, etc. to the inlet 80 of the motionless mixer 52. The mixer housing 81 preferably is elongate and substantially completely encloses the interior volume 82 thereof except for the inlet 80 and outlet 55. A plurality of mixing elements 83 and mixing chambers 84 therebetween effect a dividing or separating function separating the inlet fluids into multiple streams, a direction changing function imparting location shifts and momentum to the individual streams, and a recombining of the material from the streams thoroughly to mix the material ultimately producing the foam-like consistency which is delivered from the effluent outlet 55. Each mixing element 83 may be formed by a flat plate-like disc 85 and a truncated conical disc 86. The discs 85, 86 are mounted on a support rod 87 and are separated from each other by spacers 88. A vibratory generator 89 may apply vibratory energy via the support rods 87 to the mixing elements 83 further to facilitate mixing action, and, if desired, thermal energy may be applied to the motionless mixer 52 via a conventional electric heating coil 90 energized by a battery 91 upon closure of a switch 92.

Details of construction and operation of the motionless mixer 52 are disclosed in the above-mentioned copending U.S. patent application Ser. No. 897,670. Summarizing such operation, the fluids passing through inlet 80 enter the housing 81 inlet chamber 82 and are caused under pressure to follow the curved walls 93 (FIG. 8) and surfaces 94 of the conical disc 86. One flow stream represented by arrow 95 enters a hole 96 in the conical disc 86, such hole being spaced radially relatively remote from the axis 97 of the mixer 52. A stream is formed by the fluid flowing through the hole 96. That stream follows the dashed arrow 95*a* in a curved direction inward toward the axis 97 until aligned with the opening 98 in the flat disc 85. The stream follows line 95*b* through such opening 98, which is angularly shifted about the axis 97 and is radially shifted to a location more proximate the axis 97 that is the opening 96. Accordingly, the stream now has imparted thereto a certain rotational inertia and exits through the opening 98 along the line 95*c* into the next downstream mixing chamber 84. The line 99 represents another flow stream which begins at a location relatively proximate the axis 97, leaves the disc 85 at opening 100 relatively remote from the axis and has a rotational inertia spinning in the opposite direction from that of the stream following the line 95. The displacement of streams, the rotational inertia imposed on the streams and the shear effected by the sharp edges of the walls 93 of the next downstream conical disc and so on will effect a thorough mixing of the material input to the motionless mixer 52. The desired consistency of the effluent with good and long term dispersion of air in the fuel can thus be obtained.

Figure 9:
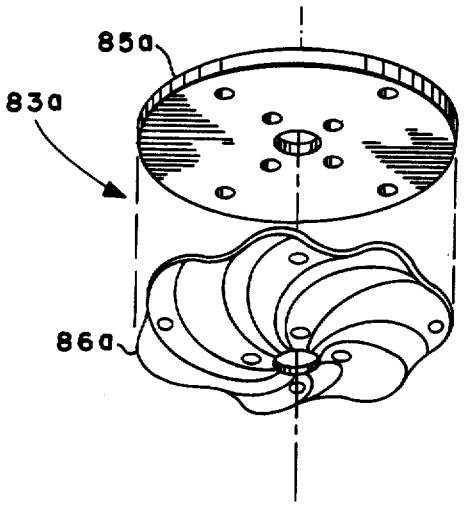
FIG. 9 is an exploded view of an alternate, but preferred, form of mixing element for the motionless mixer.

Referring briefly to FIG. 9, a modified combination of discs 85*a*, 86*a*, for use as mixing elements in a motionless mixer 52 are illustrated—these representing the preferred embodiment and best mode of mixing element believed useful in the motionless mixer for the desired purpose of mixing a grease-like coal fuel and air. The principal difference between the mixing element 83*a* is that the conical disc 86*a* does not have sharp walls 93; rather the transition between the various curved wall sections of the conical disc is more wave-like to provide a relatively smooth directional gradient thereacross. Such format will minimize the congestive accumulation of material in the motionless mixer when the viscosity and abrasive characteristics are relatively high. On the other hand, the truncated conical disc 86*a* is appreciably more difficult and expensive to manufacture relative to the disc 86 and to that extent may be less preferred than the disc 86.

STATEMENT OF INDUSTRIAL USE

With the foregoing in mind it will be appreciated that the heat exchanger combustion chamber 2, and motionless mixer 52 may be used in concert in a system 40 to effect thorough and efficient preparation and combustion of fuel while obtaining efficient thermal energy transfer characteristics to remove the heat from the combustion chamber. Additionally, a facile and efficient control may be provided for controlling thermal energy output.

I claim:

1. A combustion apparatus, comprising a combustion chamber, inlet means for permitting fuel and air to enter said combustion chamber, outlet means for permitting exhaust products of combustion to exit said combustion chamber, and dispersing means in said combustion chamber for controllably dispersing a mixture of such fuel and air therein, said dispersing means comprising dividing means for dividing a mixture of such fuel and air into plural streams and combining means for recombining such streams, said combustion chamber comprising a housing with a flow path therethrough, said dividing means comprising plate means for blocking flow and plural opening means in said plate means for passing respective streams therethrough, said combining means for comprising further plate means for blocking flow and one opening means therein for passing a recombined flow stream therethrough, and means for holding said plate means and further plate means in said housing to position said plural and one opening means in said flow path, said plate means comprising thermally conductive heat transfer means exposed inside and outside of said combustion chamber for transmitting heat by conduction from inside said combustion chamber to the outside thereof.

2. A combustion apparatus, comprising a combustion chamber, inlet means for permitting fuel and air to enter said combustion chamber, outlet means for permitting exhaust products of combustion to exit said combustion chamber, and dispersing means in said combustion chamber for controllably dispersing a mixture of such fuel and air therein, said dispersing means comprising dividing means for dividing a mixture of such fuel and air into plural streams and combining means for recombining such streams, said combustion chamber comprising a housing with a flow path therethrough, said dividing means comprising plate means for blocking flow and plural opening means in said plate means for passing respective streams therethrough, said combining means comprising further plate means for blocking flow and one opening means therein for passing a recombined flow stream therethrough, and means for holding said plate means and further plate means in said housing to position said plural and one opening means in said flow path, and further comprising a porous medium means positioned between respective relatively adjacent plate means and further plate means for further dispersing material flowing therethrough.

3. A combustion apparatus, comprising a combustion chamber, inlet means for permitting fuel and air to enter said combustion chamber, outlet means for permitting exhaust products of combustion to exit said combustion chamber, and thermally conductive heat transfer means exposed inside and outside of said combustion chamber for transmitting heat by conduction from inside said combustion chamber to the outside thereof, said combustion chamber comprising a housing with a flow path along which flows a mixture of fuel and air, in which combustion occurs, and along which flow the exhaust products of combustion, said heat transfer means comprising plate means having substantial surface areas thereof exposed directly in said flow path and further substantial surface areas thereof exposed outside said flow path to the environment outside said housing, and said plate means having openings therein positioned in said flow path and forming a part thereof.

4. A combustion apparatus, comprising a combustion chamber, inlet means for permitting fuel and air to enter said combustion chamber, outlet means for permitting exhaust products of combustion to exit said combustion chamber, and thermally conductive heat transfer means exposed inside and outside of said combustion chamber for transmitting heat by conduction from inside said combustion chamber to the outside thereof, said combustion chamber comprising a housing with a flow path along which flows a mixture of fuel and air, in which combustion occurs, and along which flow the exhaust products of combustion, said heat transfer means comprising plate means having substantial surface areas thereof exposed directly in said flow path and further substantial surface areas thereof exposed outside said flow path to the environment outside said housing, and further comprising dispersing means in said combustion chamber for controllably dispersing a mixture of such fuel and air therein, said dispersing means comprising a porous medium means positioned in said flow path for dispersing material flowing therethrough, said dispersing means comprising thermally conductive material and having surface areas in thermally conductive engagement with said substantial surface areas of said plate means.

5. A combustion apparatus, comprising a combustion chamber, inlet means for permitting fuel and air to enter said combustion chamber, outlet means for permitting exhaust products of combustion to exit said combustion chamber, and flow directing means for directing the flow of fuel and air in said combustion chamber, said flow directing means comprising means for chemically lowering the quantity of at least one material in the exhaust products of combustion, said combustion chamber comprising a housing, and a substantially closed flow path in said housing leading from said inlet means to said outlet means and along which a mixture of fuel and air flows, in which combustion occurs, and along which exhaust products pass, and said flow directing means being positioned in said flow path, said flow directing means comprising a porous medium, and further comprising means for changing said porous medium, said means for changing comprising guide means for serially guiding insertion of one porous medium into said flow path while ejecting another porous medium from said flow path, and further comprising dispersing means in said combustion chamber for controllably dispersing a mixture of such fuel and air therein, said dispersing means including dividing means for dividing the mixture of fuel and air into plural streams and combining means for recombining such streams, said dividing means comprising plate means for blocking flow and plural opening means in said plate means for passing respective streams therethrough, said recombining means comprising further plate means for blocking flow and one opening means therein for passing a recombined flow stream therethrough, means for holding said plate means and said further plate means in said housing to position said plural and one opening means in said flow path, and said guide means comprising guide track means on said plates.

6. Method of combustion of a fuel, comprising mixing air with such fuel to form a foam-like material, and effecting substantially continuous combustion of such foam-like material while maintaining at least partial relative pressurization thereof, and further comprising combining a particulate fuel with a further material to form a fluid-like emulsion thereof, and said mixing comprising mixing air with such emulsion.

7. The apparatus of claims 1 or 2, wherein the sum of cross-sectional areas of said plural opening means in one of said plate means is approximately equal to the cross-sectional area of said one opening means in one of said further plate means.

8. The apparatus of claims 1 or 2, said plate means comprising a plurality of the same, and said further plate means comprising a plurality of the same, said plate means and further plate means being positioned in alternating sequence in said flow path.

9. The apparatus of claim 2, said porous medium comprising means for chemically lowering the quantity of at least one material in the exhaust products of combustion.

10. The apparatus of claim 3, said plate means comprising dividing means for dividing a mixture of the fuel and air into plural streams and combining means for recombining such streams.

11. The apparatus of claim 5, said flow directing means comprising limestone and such one material comprising sulphur in the exhaust gas.

12. Apparatus for preparing and burning coal, comprising combining means for combining particulate coal with a petroleum or petroleum-like material to form a mixture having grease-like characteristics, mixing means for mixing such grease-like mixture with air to form a foam-like dispersion mixture thereof, means for maintaining a relative pressure on such foam-like dispersion mixture to retain the relative dispersion of coal and air thereof, and combustion chamber means for providing an environment for controlled combustion of such coal and air of such foam-like dispersion mixture.

13. The apparatus of claim 12, said mixing means comprising a motionless mixer.

14. The apparatus of claim 12, said means for maintaining comprising pump means for applying a pressure head to such mixture for delivery under pressure to said combustion chamber.

15. The apparatus of claim 14, said means for maintaining comprising means for maintaining substantially continuous constant pressure on such mixture, said combustion chamber comprising a substantially closed substantially constant, or otherwise controlled cross-sectional open area, chamber having a flow path therethrough between an inlet thereto and an outlet therefrom, and said means for maintaining further comprising pump means for pumping a mixture of fuel and air at a pressure head and in said combustion chamber for impeding flow of such mixture therethrough.

16. The apparatus of claim 12, said combining means comprising means for washing and at least partially drying the coal.

17. The apparatus of claims 13 or 16, further comprising means for adding polymer to such mixture.

18. The method of claim 6, said combining comprising combining coal with a petroleum or petroleum-like product.

19. The method of claim 18, said combining comprising combining polymer in such emulsion.

20. The method of claim 18, said combining comprising combining limestone in such emulsion.

21. The method of claim 6, said mixing comprising effecting such mixing in a motionless mixer.

22. The method of claim 6, said mixing comprising pumping fuel through a mixing apparatus and in the mixing apparatus dispersing air in the fuel.

23. The method of claim 6, said effecting comprising effecting combustion in a substantially closed, substantially constant, or otherwise controlled cross-sectional open area, combustion chamber having an inlet to receive such foam-like material and an outlet to discharge the exhaust products of combustion.

24. The method of claim 6, said effecting comprising effecting combustion in a combustion chamber, and further comprising controlling at least one of the flow rate and pressure of such foam-like material supplied to such combustion chamber thereby to control combustion in such combustion chamber.

25. Method of preparing particulate fuel for combustion, comprising combining a fluid material with such fuel to form a fluid-like mixture thereof, and mixing air with said fluid-like mixture to form a foam-like mixture.

26. The method of claim 25, said combining comprising combining coal and a petroleum or petroleum-like product.

27. The method of claim 25, said combining further comprising combining polymer in such fluid-like mixture.

28. The method of claim 25, said mixing comprising mixing in a motionless mixer.

29. The method of claim 28, further comprising applying a pressure head to such fluid-like mixture to urge the same and air through such motionless mixer.

30. Method of preparing and burning coal, comprising combining particulate coal with a petroleum or petroleum-like material capable of forming a mixture having grease-like characteristics, mixing such grease-like mixture with air to form a foam-like dispersion mixture of such grease-like mixture and air, maintaining a relative pressure on such foam-like dispersion mixture substantially to maintain the relative dispersion of air and grease-like material, and effecting combustion of such foam-like dispersion mixture.

* * * * *